United States Patent [19]

Schmidt

[11] 4,444,265

[45] Apr. 24, 1984

[54] DRAIN HOLE DRILLING

[75] Inventor: Jerry W. Schmidt, Hobbs, N. Mex.

[73] Assignee: Atlantic Richfield Company, Los Angeles, Calif.

[21] Appl. No.: 414,211

[22] Filed: Sep. 2, 1982

[51] Int. Cl.[3] ..... E21B 33/138; E21B 43/32

[52] U.S. Cl. ..... 166/295; 166/50; 175/61

[58] Field of Search ..... 166/295, 294, 50; 175/61, 62

[56] References Cited

U.S. PATENT DOCUMENTS

| | | | |
|---|---|---|---|
| 2,236,836 | 4/1941 | Prutton | 166/295 |
| 2,404,341 | 7/1946 | Zublin | 166/50 |
| 2,713,906 | 7/1955 | Allen | 166/295 |
| 3,297,088 | 1/1967 | Huit et al. | 166/295 |
| 3,779,315 | 12/1973 | Bonean | 166/295 |
| 3,782,467 | 1/1974 | Hessert | 166/295 |
| 4,009,755 | 3/1977 | Sandiford | 166/295 |

OTHER PUBLICATIONS

Moore III, "ARCO Drills Horizontal Drainhole for Better Reservoir Placement", Oil and Gas Journal, Sep. 15, 1980, 175–61.

*Primary Examiner*—Stephen J. Novosad
*Assistant Examiner*—Hoang C. Dang
*Attorney, Agent, or Firm*—Roderick W. MacDonald

[57] ABSTRACT

A method for enhancing the recovery of liquid products from a wellbore having at least one laterally extending drain hole wellbore extending therefrom wherein a portion of the earth around the primary wellbore and a part of the drain hole wellbore is treated to render same essentially gas impermeable so that gas cannot prematurely cone into the primary wellbore, thereby enhancing the liquid recovery by way of the drain hole wellbore before gas reaches the drain hole wellbore.

11 Claims, 4 Drawing Figures

DRAIN HOLE DRILLING

BACKGROUND OF THE INVENTION

Heretofore, various types of deviated wellbores have been drilled from a primary wellbore. One particular type of deviated wellbore, known as a drain hole, is drilled from a primary wellbore through a sharp radius of curvature so as to extend laterally away from the primary wellbore. Normally, although not necessarily, the primary wellbore is essentially vertical and the drain hole, after passing through its sharp radius of curvature extends essentially horizontally away from the primary wellbore out into the producing geologic formation. Drain holes, and the method for drilling same, are fully and completely disclosed in U.S. Pat. Nos. 3,349,845 and 3,398,804.

BRIEF SUMMARY OF THE INVENTION

Often the drain hole is deliberately drilled into a liquid, e.g. crude oil, producing formation or strata to maximize the recovery of liquid therefrom. Such a formation or strata sometimes has adjacent thereto a gas, e.g. natural gas, producing formation or strata overlying or otherwise adjacent the liquid producing formation. In those cases, the potential is present for producing both gas and liquid from the drain hole into the primary wellbore for recovery of both gas and liquid at the surface of the earth.

It has been found that in some such situations, the the gas may preferentially sweep into the drain hole, particularly in the area of the radius of curvature of the drain hole, thereby reducing the amount of liquid produced from the drain hole. According to this invention, a method for drilling drain hole wellbores is provided which enhances liquid production from the drain hole by first treating a significant portion of the earth around the primary wellbore in the gas and liquid producing area to render the treated portion essentially impermeable to gas. Thereafter, the drain hole is drilled through the thus treated portion of the earth out into untreated, liquid producing portions of the earth. This way, in order for gas to reach the drain hole, it has to push through the bulk of the liquid producing formation, thereby forcing liquid out of the formation to a maximum extent before the gas reaches the drain hole. This, in turn, substantially enhances the recovery of liquid by way of the drain hole.

Accordingly, it is an object of this invention to provide a new and improved method for increasing the productivity of new or old primary wellbores. It is another object to provide a new and improved method for drilling for and producing hydrocarbonaceous fluids from the earth. It is another object to provide a new and improved method for enhancing the recovery of fluids by way of a drain hole wellbore when gas is closely associated with a liquid.

Other aspects, objects and advantages of this invention will be apparent to those skilled in the art from this disclosure and the appended claims.

DETAILED DESCRIPTION OF THE INVENTION

Figure 1:
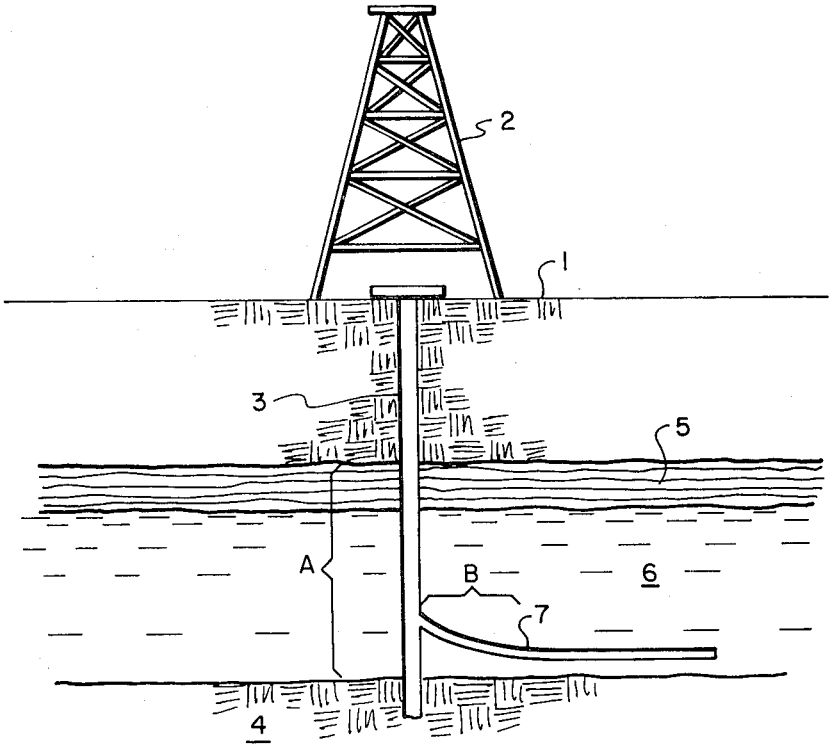
FIG. 1 shows a cross-section of a primary wellbore and drain bore wellbore in the earth.

FIG. 1 shows the surface of the earth 1 with drilling rig 2 set over a primary wellbore 3 which extends essentially vertically downwardly into the earth 4. In area A of primary wellbore 3 are two fluid producing geologic formations, for example, an upper formation 5 which produces natural gas, and a lower formation 6 which produces liquid crude oil. A drain hole wellbore 7 has been drilled laterally from wellbore 3 and, after passing through a radius of curvature portion B, extends essentially horizontally away from wellbore 3 out into oil producing formation or strata 6. Wellbore 7 thereby enhances the flow of oil from formation 6 into drain hole 7 for production to the earth's surface 1 in a conventional manner by way of primary wellbore 3.

Wellbores 3 and 7 can be either cased or uncased, cemented or uncemented, as far as the application of this invention goes. Wellbore 3 can be a newly drilled well or an old well that is being worked over for drain hole purposes. The invention will be described hereinafter, only for sake of simplicity, as though both the wellbores were newly drilled and not cased or cemented. However, it should be understood that this invention also applied to cased and/or cemented wellbores, work overs, and the like.

Figure 2:
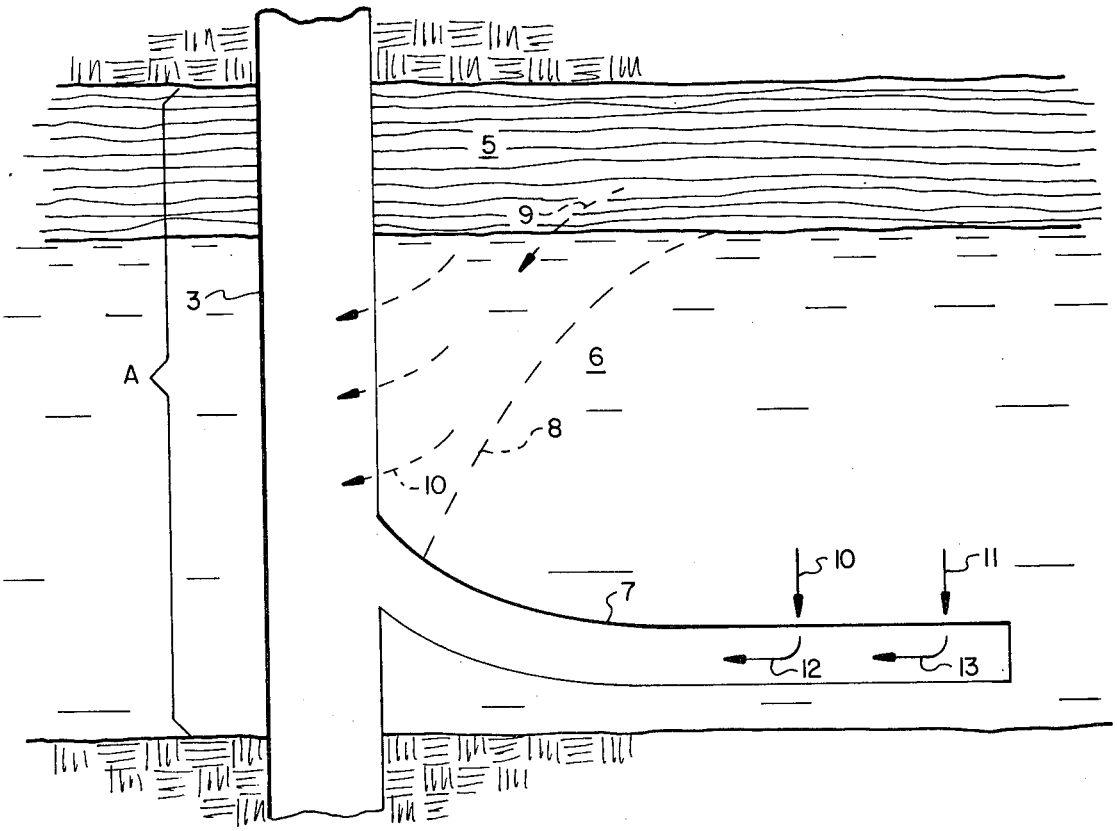
FIG. 2 shows an enlarged cross-section of the primary and drain hole wellbores of FIG. 1 when gas and oil are produced without the practice of this invention.

FIG. 2 shows the situation of oil and gas production into primary wellbore 3 after production has been carried out for a while. What sometimes occurs in such a situation is that gas, because of its greater mobility in the earth, will cone downwardly toward drain hole 7 as indicated by dotted line 8 and arrows 9 and 10, so that gas enters primary wellbore 3 ahead of liquid oil, as represented by arrows 10 through 13, inclusive. Gas coning into the drain hole prematurely decreases the amount of liquid produced by way of the drain hole. This is disadvantageous because, ideally, all liquid is produced from reservoir 6 first taking advantage of the pressure drive from the gas in reservoir 5 to help drive the oil out of reservoir 6. However, if gas prematurely escapes to primary wellbore 3 by coning, the gas cap can be depleted and its assistance in removing oil from reservoir 6 reduced before the optimum amount of oil has been recovered from reservoir 6 by way of drain hole 7.

Figure 3:
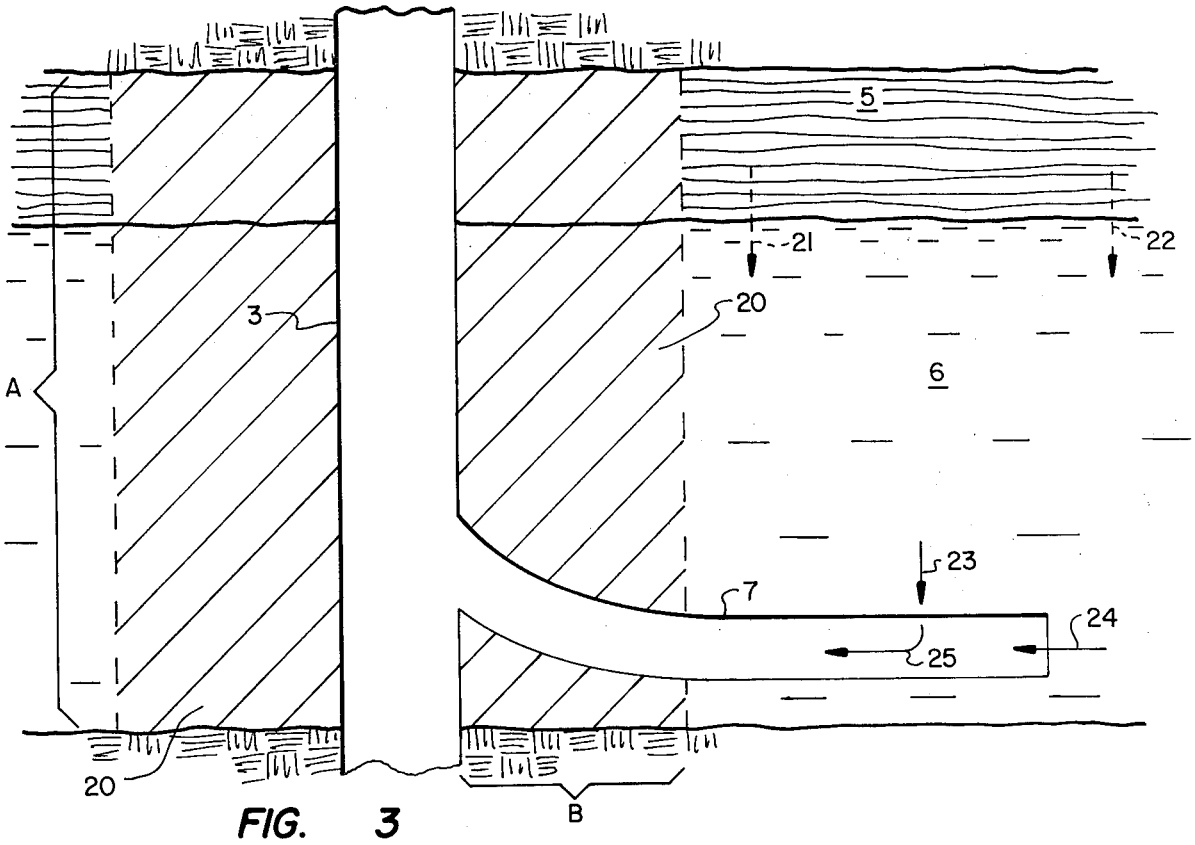
FIG. 3 shows an enlarged cross-section of the same primary and drain hole wellbores and the production of gas and oil therefrom after treatment around the primary wellbore in accordance with this invention.

FIG. 3 shows primary wellbore 3 after a radial area therearound and extending vertically over area A has been treated in accordance with this invention. That is to say, prior to the drilling of drain hole 7 outwardly from wellbore 3, a cylindrical volume 20 was established which extends a substantial radial distance away from wellbores 3 in both gas producing formation 5 and oil producing formation 6. Zone 20 has been produced by injecting into the earth, outwardly from wellbore 3, a material which fills the pores of the earth in zone 20 and with time, heat and the like hardens to render zone 20 essentially impermeable to gas from formation 5. After such treatment of zone 20 around wellbore 3, drain hole 7 is then drilled so that at least part of the radius of curvature part B of drain hole 7 is in the treated area 20. The radius of curvature referred to herein is the curved part of drain hole 7 which stops when drain hole 7 reaches an essentially horizontal position in the case where primary wellbore 3 is essentially vertical, or, in other situations, where drain hole 7 reaches approximately a perpendicular attitude with respect to the primary wellbore. Although any significant treatment of zone 20 is helpful in the prevention of gas coning, it is presently preferred that the area of treatment cover essentially all of the radius of curvature of drain hole 7. It should be understood, however, that such treatment can cover less than the radius of curvature B or can extend beyond such radius of curvature if desired by the operator and economical.

It can be seen from FIG. 3, that by establishing a relatively gas impermeable zone 20 in area A around wellbore 3, gas from formation 5 is prevented from prematurely coning into drain hole 7 as shown in FIG. 2. Because of this invention, gas must move downwardly directly toward drain hole 7 as indicated by dotted arrows 21 and 22, thereby pushing a maximum amount of oil ahead of it into drain hole 7 as shown by arrows 23, 24 and 25. Thus, gas does not prematurely enter wellbores 3 or 7 and, by the time the gas does reach drain hole 7, it has pushed essentially all of the oil ahead of it into drain hole 7 for maximum enhanced recovery of oil from formation 6. This invention provides a more efficient recovery of liquid from a reservoir which has adjacent thereto an in-situ gas source.

Figure 4:
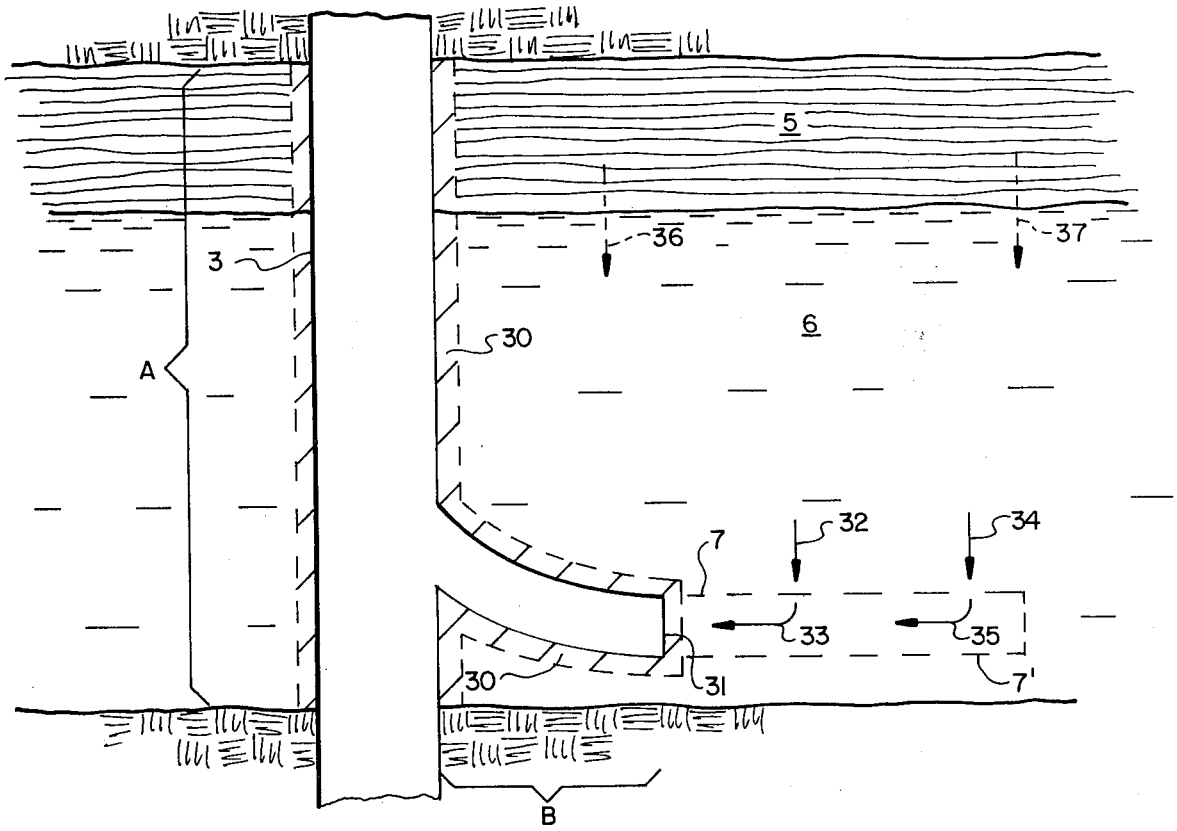
FIG. 4 shows yet another embodiment of this invention.

FIG. 4 shows primary wellbore 3 passing through gas and oil producing zones 5 and 6. In this embodiment of the invention, after primary wellbore 3 is drilled, the drain hole wellbore 7 is started from wellbore 3 but drilled only through the radius of curvature portion B. When the drain hole is drilled to point 31 where it essentially levels out horizontally and will thereafter be passing directly away from wellbore 3, drilling of drain hole wellbore 7 is terminated. Thereafter, the earth surrounding wellbore 3 in area A and the earth surrounding the radius of curvature path B of drain hole wellbore 7 is treated to produce the desired essentially gas impermeable zone 30 around wellbore 3 and radius of curvature B of drain hole wellbore 7. After this treatment, wellbore 3 is re-entered with drilling equipment and drain hole wellbore 7 extended beyond its radius of curvature terminating at point 31. This extension drilling goes as far out into oil producing strata 6 as desired, as shown by dotted line 7'. By practicing this embodiment of the invention, less material can be used to produce a desirable gas impermeable zone 30 than was used to produce gas impermeable zone 20 of FIG. 3. Thus, the desired result of the production of liquid oil, represented by arrows 32, 33, 34 and 35, due at least in part to pressure from gas travelling downwardly towards the untreated portion of drain hole wellbore 7, represented by arrows 36 and 37, is accomplished. The gas forces essentially all of the oil out of strata 6 before the gas reaches the untreated portion 7' of drain hole wellbore 7 since premature coning of the gas into primary wellbore 3 and radius of curvature portion B of drain hole wellbore 7 is prevented by zone 30. This may be achieved by the use of a minimum amount of treating material. For example, if radius of curvature B extends 15 ft. away from primary wellbore 3, and it is desired to treat the earth in accordance with this invention to render the entire radius of curvature distance relatively gas impermeable, by using the approach of FIG. 3, treating material will be squeezed outwardly from wellbore 3 a distance of 15 ft. for the treatment described in FIG. 3. However, for the treatment described in FIG. 4, the distance of treatment away from wellbore 3 and the radius of curvature part of drain hole wellbore 7 to establish zone 30 in FIG. 4 could be on the order of 1 to 3 radial ft. Obviously, if less than the entire radius of curvature portion B of drain hole wellbore 7 is to be treated, the approach of FIG. 3 will be more practical.

Either approach represented by FIG. 3 or FIG. 4, or combination of those approaches or other similar approaches will be obvious to those skilled in the art based upon this disclosure and such combinations of approaches and obvious similar approaches are all within the scope of this invention. For example, another approach that could be used in the practice of this invention is to drill primary wellbore 3. Thereafter drill the entire drain hole wellbore 7 and after completing drilling of the entire drain hole wellbore, putting a bridge plug or other packoff means any place desired in drain hole wellbore 7, such as at point 31 of FIG. 4. Subsequent treatment of the primary wellbore 3 in area A and the radius of curvature portion B of drain hole wellbore 7 up to the bridge plug can be accomplished without treating the entire length of the fully drilled drain hole wellbore 7. This way, the results of FIG. 4, i.e. establishment of zone 30, are obtained.

Generally, any material which is not soluble to a substantial degree in the gas, oil or other gaseous or liquid fluids to be produced from the formations adjacent the wellbores can be used to form impermeable zones 20 and 30 so long as those materials can be made sufficiently liquid to be pumped down wellbore 3 and forced outwardly therefrom by pressure into the earth to form zone 20 and 30, and thereafter solidified to a sufficient extent to render zones 20 and 30 essentially gas impermeable. A number of materials are known in the art which can be injected into the pores of a geologic formation as a liquid which will then, with time, heat, catalyst, and the like, essentially solidify to plug the formations pores against gas incursion. Such materials will be readily obvious to one skilled in the well drilling art and cover a wide variety of materials. Particularly useful materials include polyacrylamides, particularly partially hydrolyzed polyacrylamides, polyacrylates, natural gums such as guar gum and xanthum, and derivatives of natural gums. Inorganic materials such as silicates, particularly alkali metal silicates such as sodium silicate can also be employed to form zones 20 and 30. Of particular use are materials in the foregoing classes of materials which are water soluble so that they can be injected into the wellbore as a readily flowable liquid and which then, after being pressured out into the formation to form zones 20 and 30, harden in-situ in the pores of the formation. Suitable materials are fully and completely disclosed in U.S. Pat. Nos. 3,011,547 and 3,827,977, the disclosures of which are incorporated herein by reference. The amount of such materials employed will vary widely depending upon the desired radial extent of zones 20 or 30 away from wellbores and the permeability of the geological formations to be plugged. Therefore, such amounts will vary widely and are not critical to the practice of this invention so long as a sufficient amount is employed to render zones 20 and 30 essentially gas impermeable. For example, in the case of U.S. Pat. No. 3,827,977, the use of larger amounts of the inhibiting agent than contemplated by that patent can result in plugging of the pores of the formation to produce relatively impermeable zones 20 and 30. Thus, the same materials can be used in the same manner but just in more substantial amounts so as to plug the pores rather than deposit a small, non-plugging amount in the pores for scale inhibition purposes. One skilled in the art, once apprised of this invention and the advantages therefor, can readily devise numerous ways to form impermeable zones 20 and 30 prior to drilling drain hole 7, and all such approaches to establishing zones 20 and 30 are within the purview of this invention.

EXAMPLE

A mixture of sixty barrels of lease water containing 8,000 to 10,000 ppm calcium, one hundred gallons of 15% hydrochloric acid, and one hundred sixty-five gallons of a 15–18% sodium polyacrylamide, molecular weight 1,000–8,000 is injected by conventional squeeze treatment into the formation in area A surrounding wellbore 3 using a sufficient volume of the mixture so as to equal one pore volume of the surrounding formation which will extend six feet radially from wellbore 3. The mixture, after being squeezed into the pores of the formation, is allowed to sit until the calcium reacts with the polyacrylamide to form calcium cross linked polyacrylamide deposits in the pores, thereby plugging the pores of the formation radially around wellbore 3 for a distance of six feet and throughout height A of formations 5 and 6. A relatively gas impermeable zone 20 is thereby formed around wellbore 3.

Thereafter, drain hole 7 is drilled from wellbore 3 in a conventional manner so as to penetrate impermeable zone 20 and extend a substantial distance out into oil producing formation 6 for maximum recovery of oil from formation 6 by way of drain hole 7 before gas from formation 5 reaches drain hole 7. Drain hole 7 is drilled near the bottom of formation 6 and as far away from formation 5 as possible in order to maximize liquid recovery before gas reaches drain hole 7.

Reasonable variations and modifications are possible within the scope of this disclosure without departing from the spirit and scope of this invention.

The embodiments of the invention in which an exclusive property or privilege is claimed are defined as follows:

1. In a method for drilling at least one drain hole wellbore which extends laterally from a primary wellbore into an area of the earth that produces both gas and liquid, the improvement comprising said area of the earth that produces both gas and liquid is composed of a liquid producing formation and at least one adjacent gas producing formation, said at least one drain hole wellbore is drilled into said liquid producing formation as far from said gas producing formation as possible while staying within said liquid producing formation, treating a significant portion of the earth around said primary wellbore in said gas and liquid producing area to render said treated portion essentially impermeable to gas, and thereafter drilling or completing drilling said at least one drain hole wellbore through said treated portion and into the untreated gas and liquid producing area whereby undesired gas coning into said primary and/or drain hole wellbores is at least substantially reduced and liquid production from said drain hole wellbore is substantially enhanced.

2. In the method according to claim 1 wherein said gas is essentially natural gas and said liquid is essentially crude oil.

3. In the method according to claim 1 wherein said at least one drain hole wellbore passes through a radius of curvature portion when it first leaves said primary wellbore, and said treated portion extends laterally from said primary wellbore for at least the distance covered by said radius of curvature.

4. In the method according to claim 1 wherein the permeability of said treated portion is reduced with at least one material which is not soluble in the gas and liquid originally present in said gas producing and liquid producing formations.

5. In the method according to claim 4 wherein said material is at least one of a silicate, polymer, and gum.

6. In the method according to claim 5 wherein said material is at least one of alkali metal silicate, polyacrylamide, polyacrylate, natural gum and derivatives of natural gum.

7. In the method according to claim 6 wherein said material is at least one of sodium silicate, partially hydrolyzed polyacrylamide, polyacrylate, guar gum and xanthum gum.

8. In the method according to claim 1 wherein said treated portion is injected with a liquid which when left in place in the earth solidifies over time to render said treated portion essentially impermeable to gas.

9. In the method according to claim 1 wherein prior to drilling said drain hole wellbore said treating of the earth around said primary wellbore is carried out to render same essentially impermeable to gas, and only after such treating step is said drain hole wellbore drilled from said primary wellbore through said treated earth and into untreated, liquid producing earth.

10. In the method according to claim 1 wherein a radius of curvature portion of said drain hole wellbore is drilled before any treating step is carried out, after drilling said radius of curvature portion the earth around said primary wellbore and said radius of curvature portion of said drain hole wellbore is treated to render same essentially impermeable to gas, and after such treating step said drain hole wellbore is extended beyond said treated earth into untreated, liquid producing earth.

11. In the method according to claim 1 wherein the drain hole wellbore is drilled in its entirety prior to any treatment step, a plug is placed in said drain hole wellbore and said primary wellbore and the portion of said drain hole wellbore upstream from said plug are treated to render same essentially gas impermeable after which said plug is removed and liquid recovered from the untreated portion of said drain hole wellbore.

* * * * *